US007793409B2

(12) United States Patent
Varkey

(10) Patent No.: US 7,793,409 B2
(45) **Date of Patent: *Sep. 14, 2010**

(54) METHODS OF MANUFACTURING ELECTRICAL CABLES

(75) Inventor: Joseph Varkey, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 97 days.

This patent is subject to a terminal disclaimer.

(21) Appl. No.: 12/260,646

(22) Filed: Oct. 29, 2008

(65) Prior Publication Data

US 2009/0089998 A1 Apr. 9, 2009

Related U.S. Application Data

(63) Continuation-in-part of application No. 12/183,207, filed on Jul. 31, 2008.

(60) Provisional application No. 60/954,156, filed on Aug. 6, 2007.

(51) Int. Cl.
*H01R 43/00* (2006.01)
*H01B 7/18* (2006.01)

(52) U.S. Cl. ..... 29/825; 29/828; 174/102 R; 174/106 R

(58) Field of Classification Search ..... 29/825, 29/828; 174/102 R, 106 R
See application file for complete search history.

(56) References Cited

U.S. PATENT DOCUMENTS 1,482,034 A * 1/1924 Reen ..... 119/534
2,604,509 A * 7/1952 Blanchard ..... 174/108
3,115,542 A * 12/1963 Palandri et al. ..... 174/102 R
3,217,083 A * 11/1965 Gore ..... 174/25 R
3,328,140 A * 6/1967 Warren ..... 428/602
6,600,108 B1 7/2003 Mydur et al.
7,005,583 B2 2/2006 Varkey et al.
7,170,007 B2 1/2007 Varkey et al.
7,188,406 B2 3/2007 Varkey et al.
2006/0137898 A1 6/2006 Kim et al.
2006/0260739 A1 11/2006 Varkey
2007/0107928 A1 5/2007 Varkey et al.
2008/0031578 A1 2/2008 Varkey et al.
2008/0128152 A1 6/2008 Varkey et al.

* cited by examiner

*Primary Examiner*—C. J Arbes
(74) *Attorney, Agent, or Firm*—Michael L. Flynn; David Hofman; Jody Lynn DeStefani

(57) ABSTRACT

A method forming at least a portion of a cable comprises providing at least one cable conductor core, extruding at least an inner layer of a polymeric insulation material over the at least one conductor core, providing a plurality of strength members having a coating of the polymeric insulation material, heating the at least one cable conductor core and the strength members, embedding the strength members into the inner layer of the cable conductor core, and extruding an outer layer of the polymeric insulation material over the cable conductor core and the plurality of strength members and bonding the outer layer to the inner layer and the coating to form the cable and provide a contiguous bond between the inner layer, the strength members, and the outer layer, wherein the polymeric insulation material of the inner layer, the strength member coating, and the outer layer are amended to enable the inner layer and the outer layer to melt at a greater rate than the strength member coating.

20 Claims, 12 Drawing Sheets

METHODS OF MANUFACTURING ELECTRICAL CABLES

CROSS-REFERENCE TO RELATED APPLICATION

This application is a continuation-in-part application of prior copending application Ser. No. 12/183,207 entitled "Methods of Manufacturing Electrical Cables" filed Jul. 31, 2008, which is entitled to the benefit of, and claims priority to, provisional patent application U.S. 60/954,156 filed Aug. 6, 2007, the entire disclosures of each of which are incorporated herein by reference.

BACKGROUND OF THE INVENTION

The statements in this section merely provide background information related to the present disclosure and may not constitute prior art. Embodiments of the present invention relates generally to wellbore cables.

In high-pressure wells, wireline is run through one or several lengths of piping packed with grease to seal the gas pressure in the well while allowing the wireline to travel in and out of the well. Insulated stranded conductors typically consist of several wires (typically copper) cabled at a lay angle around a central wire, with one or more layers of polymeric insulation extruded over the bundled strands. The insulation is not able to penetrate into the spaces between the conductor strands. Additional space is typically left between the central strand and the next layer of stranded wires, and between the insulation and the outer surface of the conductor wires, which create a potential pathway for high-pressure downhole gases. When the cable is being pulled out of the wellbore at high speed, these gases can decompress, leading to bulging insulation. If the gases decompress rapidly, this can even cause the insulation to burst, through the phenomenon of explosive decompression.

Problems with gas migration through interstitial spaces are also observed in coaxial cables and individual insulated conductors. In coaxial cables, a central, insulated conductor is covered in a served shield consisting of individual wires ranging in diameter from about 8 mm to about 14 mm. An additional jacket is placed over the served shield, followed by two layers of served armor wire. Because these wires do not "dig in" sufficiently to the central conductor's insulation, individual wires can become raised up above the other wires and "milk back" during the manufacturing process, damaging the cable. Individual wires can also cross over each other, causing high spots in the served shield, which can lead to similar damage. Because the served wires are not firmly affixed to the conductor, compression extrusion of the outer jacket layer would displace the shield wires. The tube extrusion methods that are compatible with unstable served shield wires leave gaps between the served shield and the outer jacket, which provide a pathway for pressurized downhole gas. The cable can be damaged when this pressurized gas is released through weak spots in the jacket through explosive decompression. It also compromises separation between the served shield and the armor wires.

Because the armor wire layers have unfilled annular gaps, gas from the well can migrate into and travel through these gaps upward toward lower pressure. This gas tends to be held in place as the wireline travels through the grease-packed piping. As the wireline goes over the upper sheave at the top of the piping, the armor wires tend to spread apart slightly and the pressurized gas is disadvantageously released.

In seismic cables used in offshore exploration, armors are typically placed around the cable's circumference at 50 to 60% coverage at a high lay angle (i.e., closer to perpendicular to the cable than other cables). Because of the space between the armors, the armors tend to milk or cross over one another during manufacture, and are not uniformly spaced. Non-uniform armor spacing can lead to weak spots in the completed cables. In gun cables, which carry extremely high air pressure, this is particularly disadvantageous.

One potential strategy to seal armor wires and prevent gas migration through the cable is known as "caging." In caging designs, a polymer jacket is applied over the outer armor wire. A jacket applied directly over a standard outer layer of armor wire would essentially be a sleeve; this would be unacceptable under loading conditions. To create a better connection with the inner layers, space is created in the outer armor wire layer by reducing armor wire coverage from 98% to between 50 and 70%.

This type of design has several problems. When the jacket suffers a cut, potentially harmful well fluids enter and are trapped between the jacket and the armor wire, causing it to rust very quickly, which may cause failure if unnoticed and, even if noticed, is not easily repaired. Certain well fluids may soften the jacket material and cause it to swell. This swelling loosens the jacket's connection with the outer armor wire layer. The jacket is then prone to being stripped from the cable when the cable is pulled through packers, or seals, or if it catches on downhole obstructions. The jacket does not provide adequate protection against cut-through. Cut-through allows corrosive well fluids to accumulate in the annular gaps between the core and the first layer of armor wires. To improve bonding between the jacket and the outer armor wires, armor wire coverage must be significantly reduced. This means fewer or smaller outer armor wires are used. As a result, cable strength is also significantly reduced.

Because of the above problems, caged armor designs can only be used currently in piping/coiled tubing systems. Even in those applications, caged armor designs will experience several of the problems mentioned above. One current manufacturing strategy to maintain uniform armor spacing in seismic cables is to place filler rods (consisting of polymeric rods or yarns encased in a polymeric extrusion) between polymer-coated armor wires. While this helps to keep the armor wires in place and maintain spacing during the manufacturing process, it also creates more interstitial spaces between the armor wires and the spacer rods.

Further issues may include contamination of spooled armor wires used in manufacturing cables with drawing lubricant, soaps, and oil and grease. While these materials can be beneficial in preventing oxidation during shipping and storage of the spooled armor wire, to ensure adequate bonding of the polymeric jackets, these armor wires must be cleaned prior to processing. When stranded armor wires are used, their irregular profile may act as a saw and may cause damage as it flexes when pulled under stress over oilfield equipment (such as sheaves, capstan pulleys, etc.). In addition, stranded armor wires are subject to the same contamination concerns as standard armor wires. In addition, electromagnetic heating (for example, by infrared radiation) has been utilized at different stages of the cable manufacturing process to bond different layers of polymer to each other. Bare armor wires may cause the bonding process to be inefficient, as much of the heating energy can be absorbed by the armor wires, which effectively serve as a heat sink and may prevent good bonding between the different layers of polymeric jacketing.

SUMMARY OF THE INVENTION

A method forming at least a portion of a cable comprises providing at least one cable conductor core, extruding at least an inner layer of a polymeric insulation material over the at least one conductor core, providing a plurality of strength members having a coating of the polymeric insulation material, heating the at least one cable conductor core and the strength members, embedding the strength members into the inner layer of the cable conductor core, and extruding an outer layer of the polymeric insulation material over the cable conductor core and the plurality of strength members and bonding the outer layer to the inner layer and the coating to form the cable and provide a contiguous bond between the inner layer, the strength members, and the outer layer, wherein the polymeric insulation material of the inner layer, the strength member coating, and the outer layer are amended to enable the inner layer and the outer layer to melt at a greater rate than the strength member coating.

Alternatively, heating comprises exposing the cable conductor core and the strength members to an electromagnetic radiation source. Alternatively, heating comprises extruding the inner layer over the strength members and substantially immediately thereafter embedding the plurality of strength members into the freshly extruded inner layer. Alternatively, heating and embedding are performed substantially simultaneously. Alternatively, the polymeric material is a virgin polymer. Alternatively, the inner layer comprises a short carbon fiber in an amount of about three percent to about five percent by weight based on total inner layer weight, and the outer layer comprises a short carbon fiber in an amount of about three percent to about five percent by weight based on total outer layer weight. Alternatively, the at least one cable conductor core comprises one of a monocable, a coaxial cable, a triad cable, a quad cable, a hepta cable, and a seismic cable. Alternatively, the plurality of strength members comprises at least one of solid armor wire strength members and stranded wire strength members.

In an embodiment, a method of forming a cable comprises providing at least one cable conductor core, extruding at least an inner layer of a polymeric insulation material over the at least one conductor core, providing a plurality of strength members having a coating of the polymeric insulation material, heating the at least one cable conductor core and the strength members, embedding the strength members into the inner layer of the cable conductor core substantially immediately after heating, and extruding an outer layer of the polymeric insulation material over the cable conductor core and the plurality of strength members and bonding the outer layer to the inner layer and the coating to form the cable and provide a contiguous bond between the inner layer, the strength members, and the outer layer, wherein the polymeric insulation material of the inner layer, the strength member coating, and the outer layer are amended to enable the inner layer and the outer layer to melt at a greater rate than the strength member coating.

Alternatively, heating comprises exposing the inner layer to an electromagnetic radiation source. Alternatively, the at least one cable conductor core comprises a one of a monocable, a coaxial cable, a triad cable, a quad cable, a hepta cable, and a seismic cable. Alternatively, the plurality of strength members comprises one of solid armor wire strength members and stranded wire strength members. Alternatively, the inner layer and outer layer are amended with short carbon fiber to enable the layers to melt at a greater rate than the strength member coating.

Alternatively, the method further comprises providing a second plurality of strength members having a coating of the polymeric insulation material, heating the outer layer and the second plurality of strength members, embedding the second plurality of conductors into the outer layer of the cable substantially immediately after heating, and extruding a second outer layer of polymeric insulation over the cable and the second plurality of conductors and bonding the outer layer to the second outer layer to form the cable and provide a contiguous bond between the inner layer, the strength members, the outer layer, the second strength members, and the second outer layer, wherein the second outer layer is amended to enable the second outer layer to melt at a greater rate than the strength member coating.

An embodiment of a method of forming a cable comprises providing at least one cable conductor core, providing a plurality of strength members having a coating of the polymeric insulation material, extruding a first layer of a polymeric insulation material over the at least one conductor core, embedding the strength members into the inner layer of the cable conductor core substantially immediately after extruding, extruding a second layer of the polymeric insulation material over the cable conductor core and the plurality of strength members and bonding the second layer to the inner layer and the coating to form the cable and provide a contiguous bond between the first layer, the strength members, and the second layer, providing a second plurality of strength members having a coating of the polymeric insulation material, embedding the second plurality of strength members into the second layer substantially immediately after extruding, and extruding a third layer of polymeric insulation over the second layer and the second plurality of strength members to form the cable and provide a contiguous bond between each of the layers and the strength members, wherein the polymeric insulation material of the layers and strength members are amended to enable the layers to melt at a greater rate than the strength member coating.

Alternatively, the at least one cable conductor core comprises a one of a monocable, a coaxial cable, a triad cable, a quad cable, a hepta cable, and a seismic cable. Alternatively, the plurality of strength members comprises one of solid armor wire strength members and stranded wire strength members. Alternatively, the polymeric material is a virgin polymer. Alternatively, the method further comprises passing the cable through at least one shaping die or wheel. Alternatively, at least one of the first, second, and third layers is amended with short carbon fiber to enable the layers to melt at a greater rate than the strength member coating.

The armor wires that are pre-coated before beginning the cable manufacturing process may alleviate problems of poor jacket bonding experienced in previous processes caused by contaminated armor wires or wire ropes and the metallic armor acting as a heat sink. Individual armor wires or wire strands or wire ropes can be more easily cleaned individually prior to being coated with an extruded polymeric jacket. The polymer may be bonded to the armor wire after cleaning the metallic surface and/or by modifying the metallic surface to make the polymer bond to the metal easily. These polymeric-jacketed and/or polymer bonded armor wires, wire strands and wire ropes can then be stored on spools until needed in the manufacturing process with much less worry about corrosion damage during storage.

Melt rates are controlled for the different polymeric layers by using one basic polymeric material for all layers, then amending the different layers with different amounts of short-carbon-fibers. The higher the fiber concentration in the polymer, the greater the interaction with electromagnetic waves used to heat the polymer, and the more quickly the amended polymer will melt. For example, due to the influence of the armor wires on the heating process, the polymer used to jacket the individual armor wires will contain a smaller or even zero percentage of carbon fibers to adjust the melt time for those polymers to match those of the cable core jacket into which the armor wires are embedded during the process. The core polymer, therefore, melts before the polymer on the jacketed wires melt.

Once the cable is completed, the overall jacket system encapsulates the armor wires and virtually eliminates any interstitial spaces between armor wires and jacketing that might serve as conduits for gas migration. This manufacturing strategy may be used for monocables, coaxial cables, heptacables, seismic cables, multi-line cables, slickline cables, any other cables used in oil exploration and other cables. It can also be applied to insulated conductors to provide gas-blocking abilities.

Embodiments of cables apply polymer coatings to fill interstitial spaces in metallic elements of oil exploration and other cables. To facilitate maximum bonding between polymers used in the cables, one base polymer will typically be used for all components in the cable with that polymer amended with various percentages by weight of short carbon fibers. A higher percentage of short carbon fibers will interact with electromagnetic waves used in the process to give those amended polymers a faster melting time. Relatively higher percentages of short carbon fibers will be used for components where faster melting times are desired to enhance the process.

Embodiments of methods provide cables with continuously bonded polymer layers, with substantially no interstitial spaces, for applications ranging from stranded conductors to served shield conductors, to armor wire systems for monocables, coaxial cables, heptacables and seismic cables. With armor wire systems, this may consist of a continuous jacket, extending from the cable core to the cable's outer diameter, while maintaining a high percentage of coverage by the armor wire layers. The jacket system encapsulates the armor wires and substantially eliminates interstitial spaces between armor wires and jacketing (or between conductor strands and insulation) that might serve as conduits for gas migration. Embodiments of methods enable cabled metallic components (such as conductor strands or armor wires) to be applied over and partially embed into slightly melted polymers. The methods include cabling the components over freshly extruded and or semi cooled extruded polymer and/or passing the polymer through a heat source like infrared (IR) substantially immediately prior to cabling, and/or using heat induction to heat the metallic components sufficient to allow them to melt the polymer and partially embed into the polymer's surface and/or using an electromagnetic heat source (for example, infrared waves) to partially melt the jacketing material very soon after each conductor strands or armor wire layer is applied over a jacket layer. This allows conductor strands or armor wires to embed in the polymeric insulation or jacketing materials, locking the armor wires in place and virtually eliminates interstitial spaces. Embodiments also comprise machines for practicing embodiments of the methods including, but not limited to, an armoring machine comprising an armor machine housing having a cable conductor inlet and outlet and at least one spool disposed within the housing and having a supply of armor wire spooled thereon for dispensing the armor wire for cabling, the spool operable to rotate with respect to the housing to allow the cable conductor to pass therethrough.

The method for forming a cable may be used for wireline cables, such as, but not limited to, monocables, coaxial cables, heptacables, quads, triads or pentad and all different seismic cables, slickline cables that incorporate stranded or served metallic members and any other cables. The method may also be applied to insulated conductors to provide gas-blocking abilities.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION OF THE INVENTION

Figure 1:
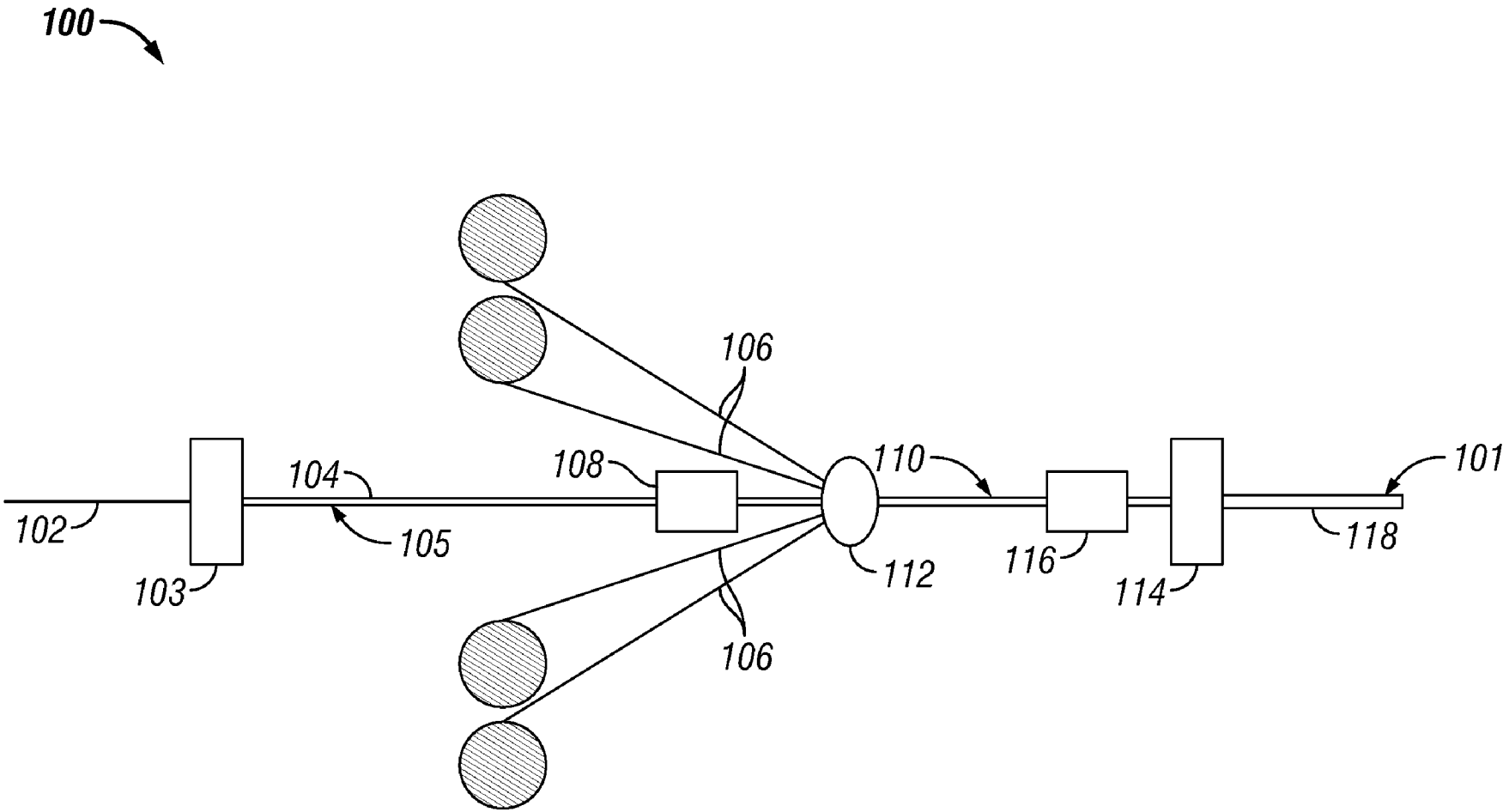
FIG. 1 is a schematic view of a method for forming a cable.
Figure 2B:
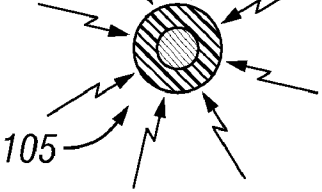
FIGS. 2*a*-2*e* are radial cross-sectional views, respectively, of a cable during various stages of formation during the method of FIG. 1.
Figure 2A:
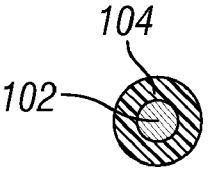
Figure 2C:
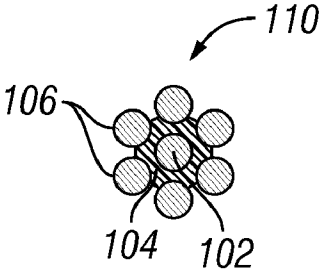
Figure 2D:
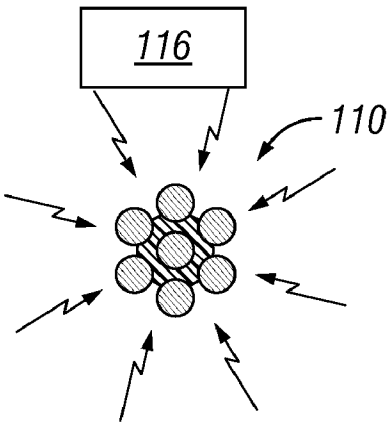
Figure 2E:
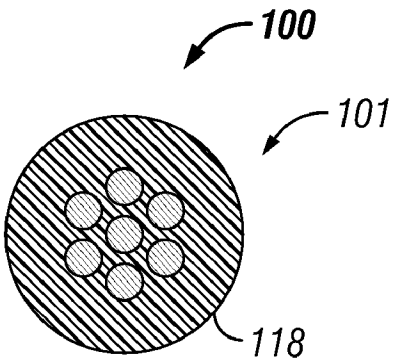
Figure 3:
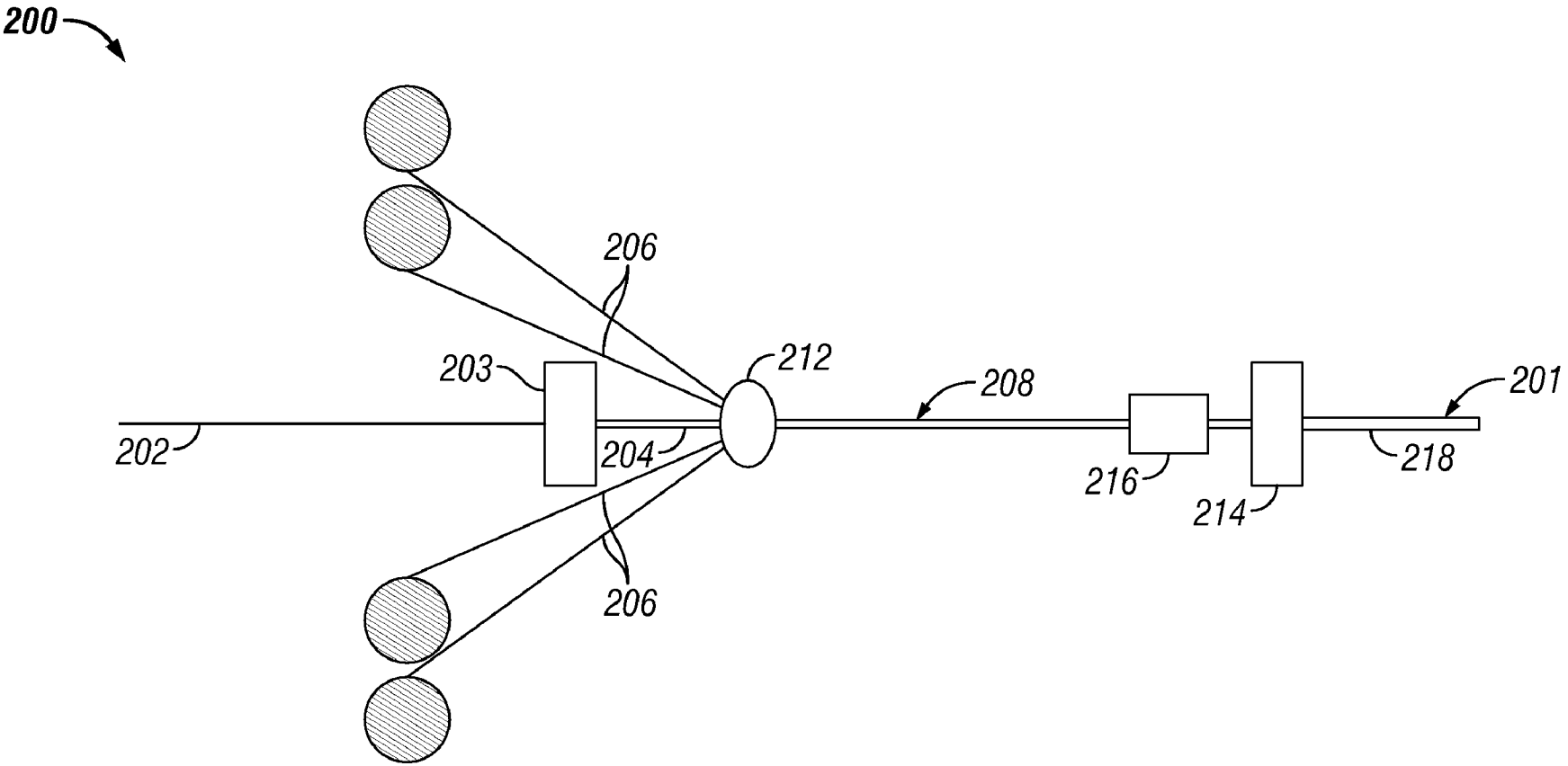
FIG. 3 is a schematic view of a method for forming a cable.
Figure 4B:
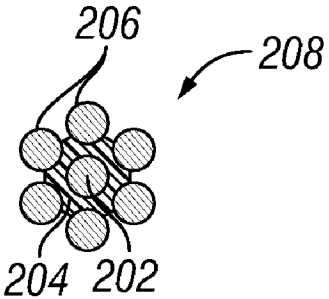
FIGS. 4*a*-4*d* are radial cross-sectional views, respectively, of a cable during various stages of formation during the method of FIG. 3.
Figure 4D:
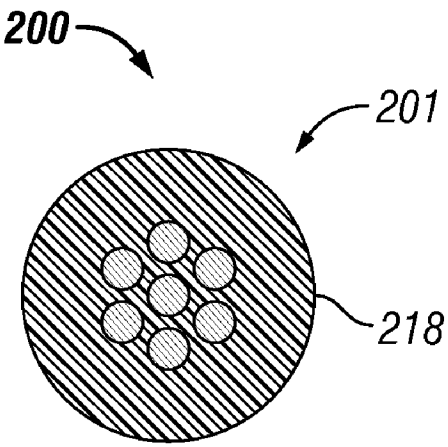
Figure 4A:
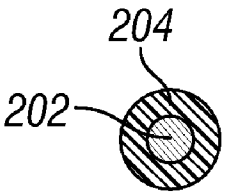
Figure 4C:
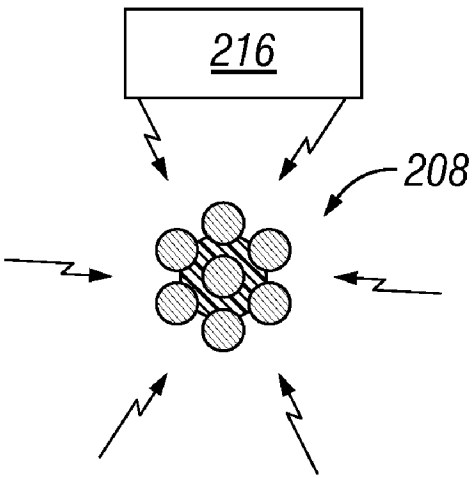

At the outset, it should be noted that in the development of any such actual embodiment, numerous implementation—specific decisions must be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure.

In the summary of the invention and this description, each numerical value should be read once as modified by the term "about" (unless already expressly so modified), and then read again as not so modified unless otherwise indicated in context. Also, in the summary of the invention and this detailed description, it should be understood that a concentration range listed or described as being useful, suitable, or the like, is intended that any and every concentration within the range, including the end points, is to be considered as having been stated. For example, "a range of from 1 to 10" is to be read as indicating each and every possible number along the continuum between about 1 and about 10. Thus, even if specific data points within the range, or even no data points within the range, are explicitly identified or refer to only a few specific, it is to be understood that inventors appreciate and understand that any and all data points within the range are to be considered to have been specified, and that inventors have disclosed and enabled the entire range and all points within the range.

Referring now to FIGS. 1 and 2*a*-2*e*, a method for forming a cable 101 is indicated generally at 100. The method 100 begins by providing, for example, a central coated strand of copper 102, and extruding (by, for example, compression extruding or tube extruding through an extruder 103) a layer of polymeric insulation 104 over the central strand 102 to form a cable conductor core 105. Those skilled in the art will appreciate that the central strand 102 may be, but is not limited to, a coated strand, an uncoated strand, or a preformed cable core comprising a plurality of conductors (such as, but not limited to, a monocable, a coaxial cable, a triad cable, a quad cable, a hepta cables, a seismic cable, or combinations thereof) and coated with a layer of tape (not shown) while remaining within the scope of the present invention. The method 100 may be performed on a separate production line with the central strand 102 spooled for use in at least a second production line that completes the method, discussed in more detail below. Preferably substantially immediately before a plurality of preferably helical copper strands or conductors 106 are applied to continue formation of the cable 101, the cable conductor core 105 passes through a heat source 108, which slightly melts or softens the insulation 104. Heating the insulation 104 prior to application of the strands or conductors 106 is thermodynamically more efficient than heating the combined assembly of central strand 102, insulation 104, and the strands or conductors 106. Next, the preferably un-insulated copper strands 106 are cabled over and partially embedded into the insulation 104 of the central strand 102 at a predetermined lay angle to form a conductor 110 comprising the central strand 102, the insulation 104, and the strands 106. As the strands 106 are cabled, the conductor 110 passes through a closing eye 112 to ensure a circular profile for the cable 101. Immediately prior to entering an extruder 114, the conductor 110 is exposed to a heat source 116, which slightly melts the insulation 104 to facilitate subsequent bonding with the insulation 104. Next, a final layer of insulation 118 is preferably compression extruded over the helical strands 106, bonding through spaces between the strands 106 with the insulation 104 below. The mechanical connection between the inner insulation layer 104 and the outer strands 106 allows the outer layer of insulation 118 to be compression-extruded without causing any damage to or milking of the outer strands 106.

Referring now to FIGS. 3 and 4*a*-4*d*, a method for forming a cable 201 is indicated generally at 200. The method 200 begins by providing, for example, a central coated strand of copper 202, and extruding (by, for example, compression extruding or tube extruding through an extruder 203) a layer of polymeric insulation 204 over the central strand 202 to form a conductor 208. Those skilled in the art will appreciate that the central strand 202 may be, but is not limited to, a coated strand, an uncoated strand, or a preformed cable core comprising a plurality of conductors and coated with a layer of tape (not shown) while remaining within the scope of the present invention. Next, shortly following the extruder 203, a plurality of preferably un-insulated copper strands 206 are cabled over and at least partially embed into the still hot and soft, freshly extruded polymer of the insulation 204 of the conductor 208 at a predetermined lay angle, which forms a conductor 210 comprising the central strand 202, the insulation 204, and the strands 206. Preferably the strands 206 are cabled over the central strand 202 a short predetermined distance from the extruder 203 to enable the freshly extruded polymer of the insulation 204 to retain the heat of the extrusion process and thereby facilitate the embedding of the strands 206 in the insulation 204. As the strands 206 are cabled, the conductor 210 passes through a closing eye 212 to ensure a circular profile for the cable 201. Immediately prior to entering an extruder 214, the conductor 210 may be exposed to a heat source 216, which slightly melts the insulation 204 to facilitate subsequent bonding with the insulation 204. Next, a final layer of insulation 218 is preferably compression extruded over the helical strands 206, bonding through spaces between the strands 206 with the insulation 204 below. The mechanical connection between the inner insulation layer 204 and the outer strands 206 allows the outer layer of insulation 218 to be compression-extruded without causing any damage to or milking of the outer strands 206.

Referring now to FIGS. 5 and 6*a*-6*f*, a method for forming a cable 301 is indicated generally at 300. The method 300 begins by providing, for example, a central coated strand of copper 302, and extruding (by, for example, compression extruding or tube extruding through an extruder 303) a layer of polymeric insulation 304 over the central strand 302. Those skilled in the art will appreciate that the central strand 302 may be, but is not limited to, a coated strand, an uncoated strand, or a preformed cable core comprising a plurality of conductors and coated with a layer of tape (not shown) while remaining within the scope of the present invention. Next, following the extruder 303, a plurality of preferably un-insulated copper strands 306 are cabled over the central strand 302 at a predetermined lay angle to form a conductor 310 comprising the central strand 302, the insulation 304, and the strands 306. Preferably immediately after the helical metallic components or strands 306 are applied, they pass through a heat induction/shaping device 312. For example, electromagnetic heat induction can be applied through a pair of mated, copper rollers 314. The heat induction rapidly heats the metallic components or strands 306. The heated components 306 slightly melt the polymeric surface or the insulation 304 and partially embed into the insulation 304. The mated wheels 314 press the heated metallic components 306 into the polymer 304 and maintain a circular cable profile. As the metallic components 306 are pressed into the polymer 304, the diameter around which they are cabled is slightly decreased. The excess metallic component length created by this change in diameter is transferred back to the spools feeding the metallic components to the process, discussed in more detail below in coverage and excess length equations for a hypothetical monocable. Immediately prior to entering an extruder 316, the conductor 310 may be exposed to a heat source 318, which slightly melts the insulation 304 to facilitate subsequent bonding with the insulation 304. Next, a final layer of insulation 320 is preferably compression extruded over the helical strands 306, bonding through spaces between the strands 306 with the insulation 304 below. The mechanical connection between the inner insulation layer 304 and the outer strands 306 allows the outer layer of insulation 320 to be compression-extruded without causing any damage to or milking of the outer strands 306.

Referring now to FIGS. 7 and 8*a*-8*e*, a method for forming a cable 401 is indicated generally at 400. The method begins by with an insulator cable or conductor 402, such as the cable 101, 201, or 301 shown in FIGS. 1-6 and formed by methods 100, 200, or 300, respectively, and having a layer of insulation 403 thereon. Those skilled in the art will appreciate that the cable 402 may be, but is not limited to, a coated strand, an uncoated strand, or a preformed cable core comprising a plurality of conductors and coated with a layer of tape (not shown) while remaining within the scope of the present invention. Preferably, substantially immediately prior to a plurality of shield wires 404 being applied, the conductor 402 passes through a heat source 406 to slightly melt or soften the insulation 403. The served shield wires 404 are then cabled onto and slightly embedded into the insulation 403 of the conductor 402, forming a cable or conductor 408. As the shield wires 404 are applied, the conductor 408 passes through a closing eye 410 to maintain a circular profile. Immediately prior to an extruder 412, the cable 408 passes through a heat source 414, which slightly melts and softens the insulation 403, to facilitate subsequent bonding with the insulation 403. The extruder 412 compression extrudes polymer 416 over the partially embedded, served wires 404 (and preferably bonds to the insulation 403) to complete the coaxial cable or cable core 401. The completed cable core 401 advantageously has virtually no unfilled interstitial spaces. The jacketing material or polymer 416 may be bonded together from the center 402 to the outer diameter of the insulation 416, if needed, which advantageously ensures reliable isolation of the served wires 404 from the armor wires (not shown), which is normally not achievable in smaller-diameter coaxial cables.

Alternatively, shortly following an extruder (not shown) extruding the layer 403 of insulation to form the cable or conductor 402, the plurality of shield wires 404, are cabled over and at least partially embed into the still hot and soft, freshly extruded polymer of the insulation 404 of the cable or conductor 402 at a predetermined lay angle to form the conductor 408 before proceeding on to the remainder of the steps of the method 400 to form the cable or cable core 401.

Figure 5:
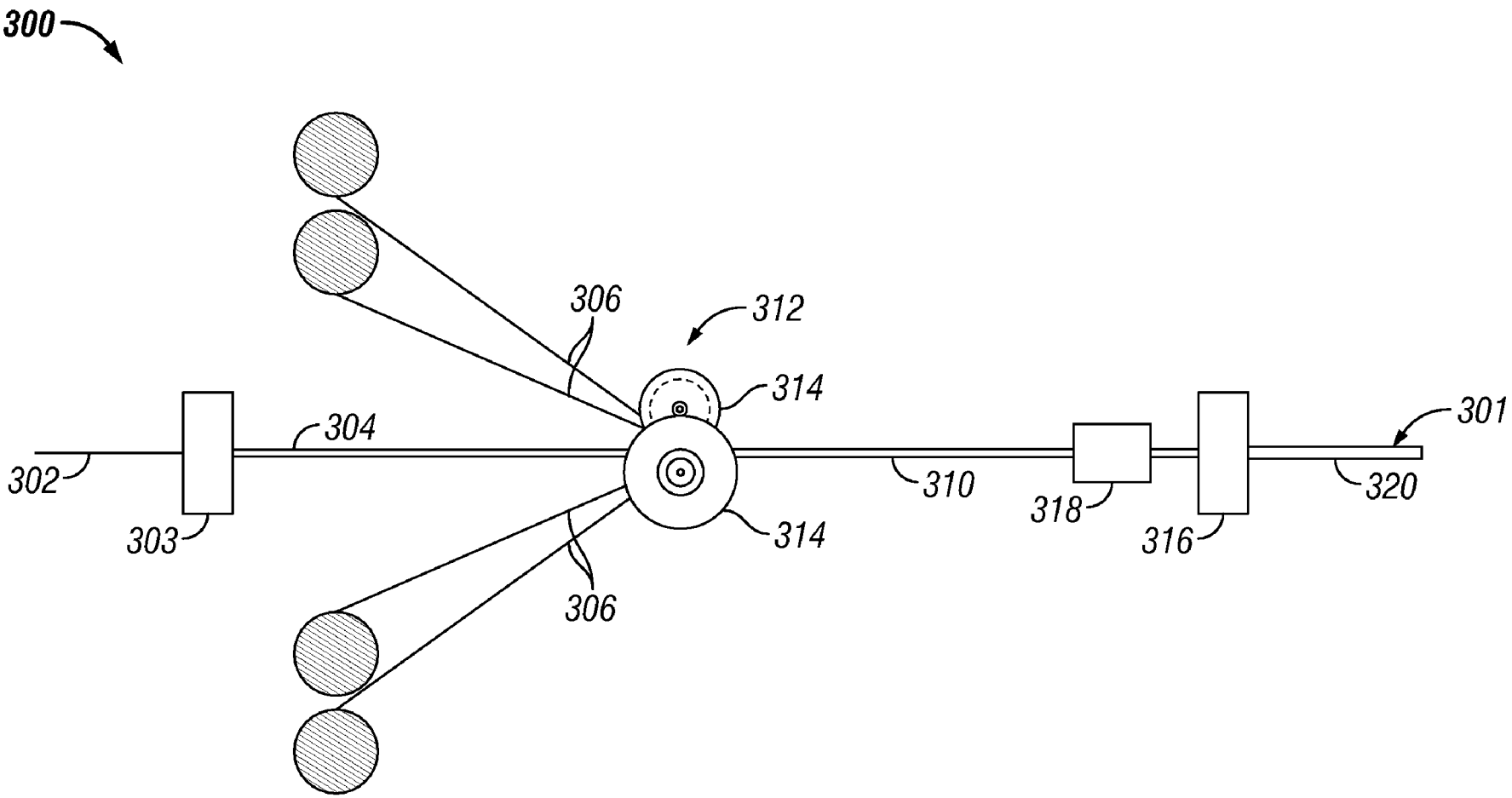
FIG. 5 is a schematic view of a method for forming a cable.
Figure 6C:
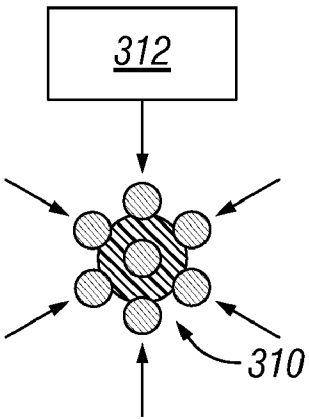
FIGS. 6*a*-6*f* are radial cross-sectional views, respectively, of a cable during various stages of formation during the method of FIG. 5.
Figure 6F:
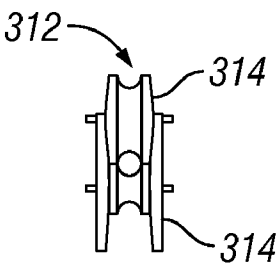
Figure 6B:
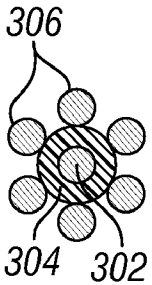
Figure 6E:
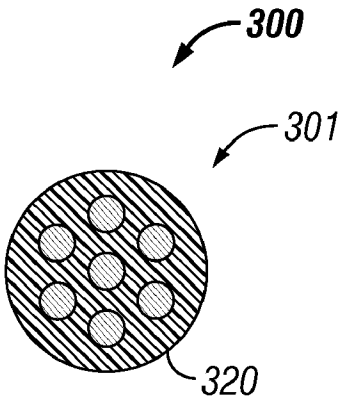
Figure 6A:
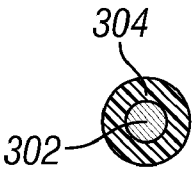
Figure 6D:
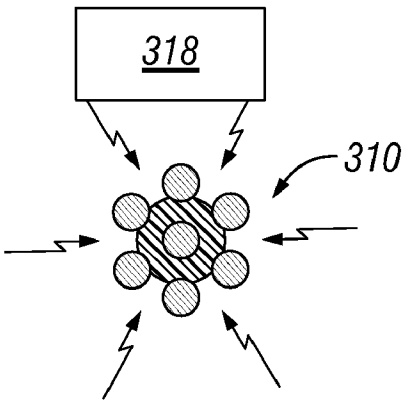

Alternatively, preferably immediately after the shield wires 404 are applied, the conductor 408 passes through a heat induction/shaping device (not shown), such as the heat induction/shaping device 312 and the pair of mated, copper rollers 314 shown in FIG. 5. The heat induction of the heat induction/shaping device rapidly heats the shield wires 404 and the heated wires 404 slightly melt the polymeric surface of the insulation 403 and partially embed into the insulation 403. The mated wheels press the heated shield wires 404 into the polymer 403 to maintain a circular cable profile and as the shield wires 404 are pressed into the polymer 403, the diameter around which they are cabled is slightly decreased, similar to the method 300 recited above before proceeding on to the remainder of the steps of the method 400 to form the cable or cable core 401. The excess wire length created by this change in diameter is transferred back to the spools feeding the wires to the process, discussed in more detail below in coverage and excess length equations for a hypothetical monocable.

Figure 7:
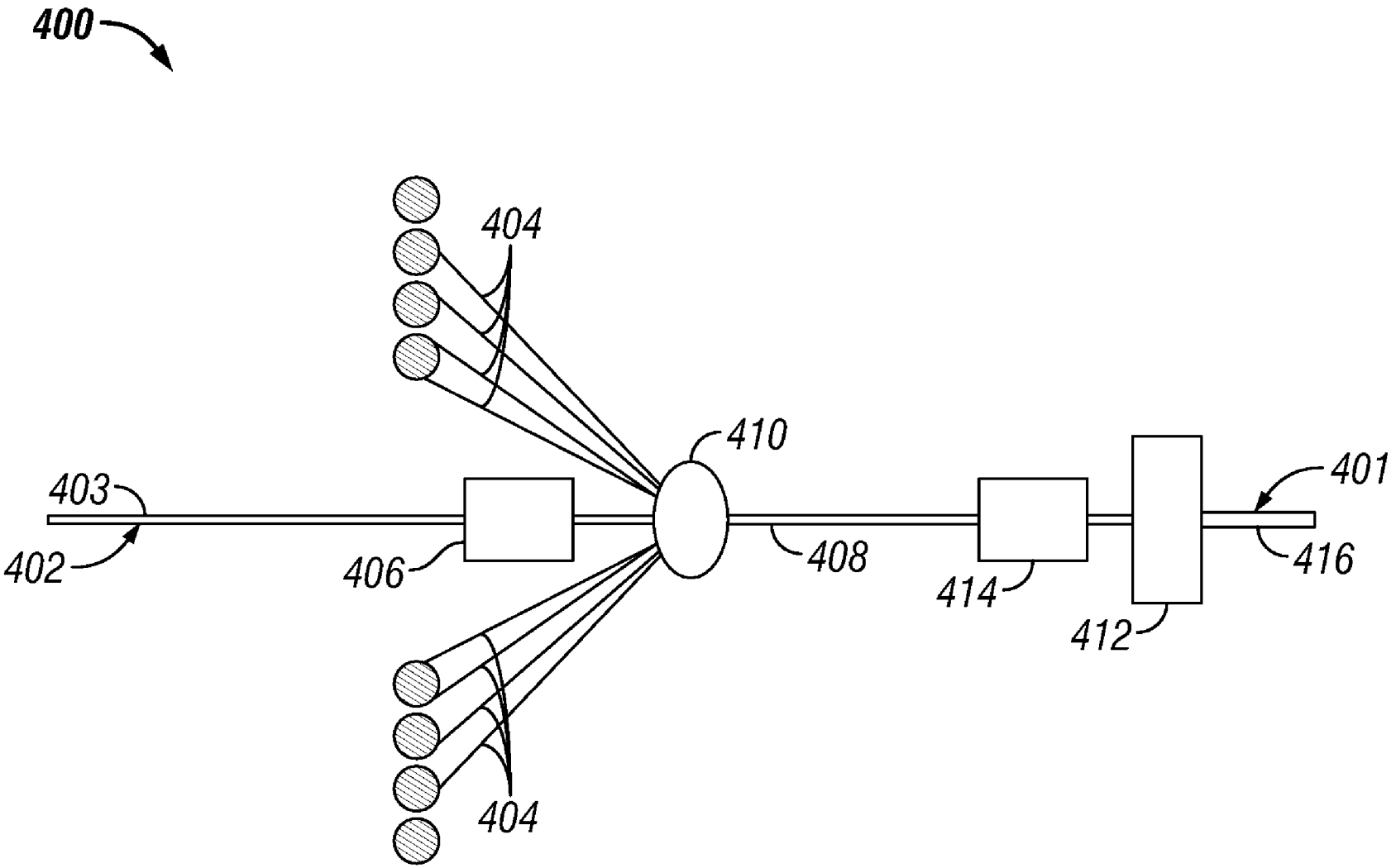
FIG. 7 is a schematic view of a method for forming a cable.
Figure 8C:
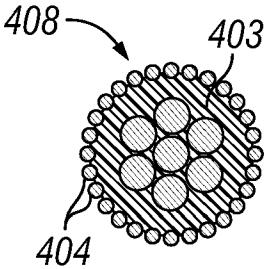
FIGS. 8*a*-8*e* are radial cross-sectional views, respectively, of a cable during various stages of formation during the method of FIG. 7.
Figure 8B:
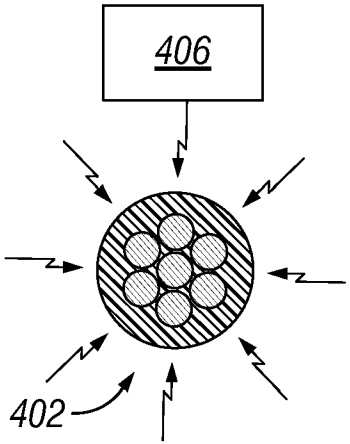
Figure 8A:
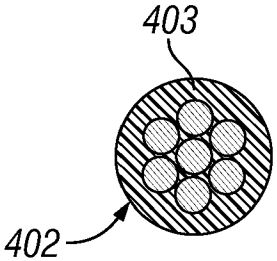
Figure 8E:
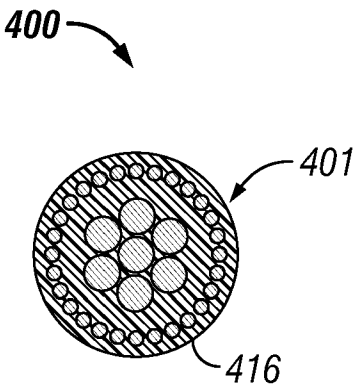
Figure 8D:
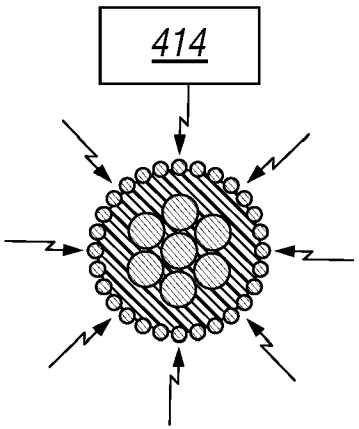

Alternatively, the methods 100, 200, 300, or 400 are utilized to form a cable having a plurality of armor wire layers (not shown) disposed about a cable core, such as the cable 401 shown in FIGS. 7-8*e* by substituting, for example, armor wires for the shield wires 404 shown in FIGS. 7-8*e* and embedding the armor wires in the polymer by passing the polymer through a heat source, by embedding the armor wires into freshly extruded polymer, or by passing the conductor through a heat induction/shaping device, to form a conductor, such as the conductor 408, as will be appreciated by those skilled in the art. Furthermore, additional extruders may be utilized to form multiple layers of armor wire and insulation and embedding the armor wire into insulation utilizing at least one of the heat source, freshly extruded polymer and the heat induction/shaping device. The cable or cables, for example, may be formed for use in the outer jacketing of a gun cable used in seismic exploration.

Figure 9:
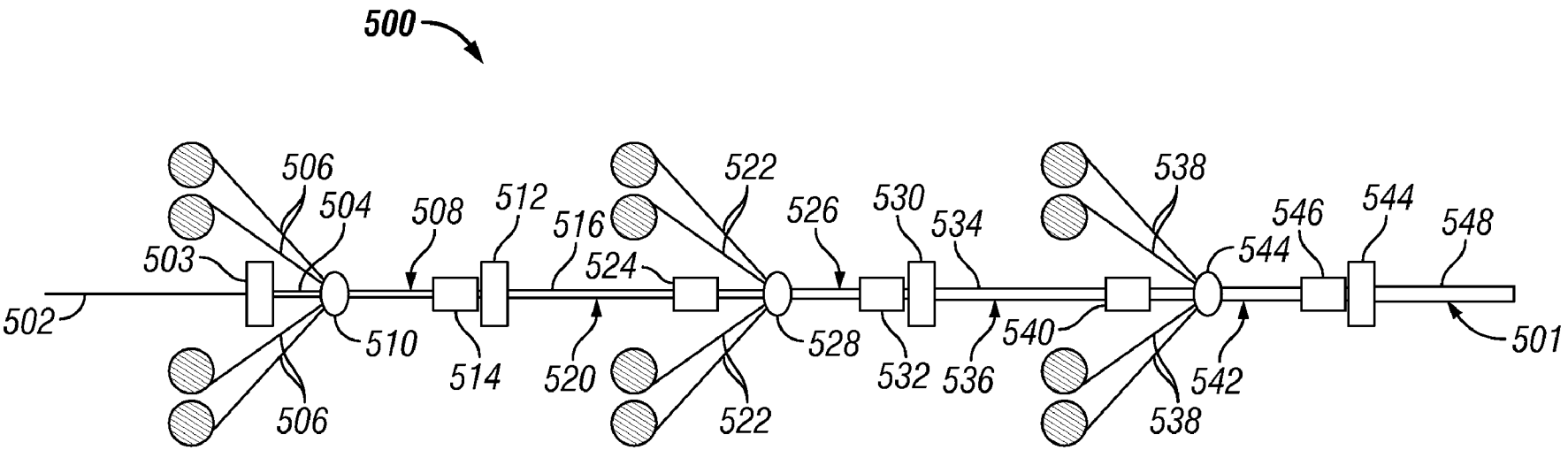
FIG. 9 is a schematic view of a method for forming a cable.

Referring now to FIG. 9, a method for forming a cable 501 is indicated generally at 500. The method 500 begins by providing, for example, a central strand of copper 502, and extruding (by, for example, compression extruding or tube extruding through an extruder 503) a layer of polymeric insulation 504 over the central strand 502. Those skilled in the art will appreciate that the central strand 502 may be, but is not limited to, a coated strand, an uncoated strand, or a preformed cable core comprising a plurality of conductors and coated with a layer of tape (not shown) while remaining within the scope of the present invention. Next, shortly following the extruder 503, a plurality of preferably un-insulated copper strands 506 are cabled over and at least partially embed into the still hot and soft, freshly extruded polymer of the insulation 504 of the central insulated strand 502 at a predetermined lay angle, which forms a conductor 508 comprising the central strand 502, the insulation 504, and the strands 506. Preferably the strands 506 are cabled over the central strand 502 a short predetermined distance from the extruder 503 to enable the freshly extruded polymer of the insulation 504 to retain the heat of the extrusion process and thereby facilitate the embedding of the strands 506 in the insulation 504. As the strands 506 are cabled, the strand 502, the insulation 504, and the strands 506 pass through a closing eye 510 to ensure a circular profile for the cable 501. Immediately prior to entering an extruder 512, the conductor 508 is exposed to a heat source 514, which slightly melts the insulation 504 to facilitate subsequent bonding with the insulation 504. Next, a further layer of insulation 516 is preferably compression extruded over the helical strands 506, bonding through spaces between the strands 506 with the insulation 504 below to form a conductor 520. The mechanical connection between the inner insulation layer 504 and the outer strands 506 allows the outer layer of insulation 516 to be compression-extruded without causing any damage to or milking of the outer strands 506.

Next, preferably immediately before a plurality of preferably helical armor wires 522 are applied to continue formation of the cable 501, the conductor 520 passes through a heat source 524, which slightly melts or softens the insulation 516. Next, the armor wires 522 are cabled over and partially embedded into the insulation 516 of the conductor 520 at a predetermined lay angle to form a conductor 526 comprising the conductor 520 and the armor wires 522. As the armor wires 522 are cabled, the conductor 526 passes through a closing eye 528 to ensure a circular profile for the cable 501. Immediately prior to entering an extruder 530, the conductor 526 is exposed to a heat source 532, which slightly melts the insulation 516 to facilitate subsequent bonding with the insulation 516. Next, a further layer of insulation 534 is preferably compression extruded from the extruder 530 over the armor wires 522, bonding through spaces between the wires 522 with the insulation 516 below to form a conductor 536.

Next, preferably immediately before a plurality of preferably helical armor wires 538 are applied to continue formation of the cable 501, the conductor 536 passes through a heat source 540, which slightly melts or softens the insulation 534. Next, the armor wires 538 are cabled over and partially embedded into the insulation 534 of the conductor 536 at a predetermined lay angle to form a conductor 542 comprising the conductor 536 and the armor wires 538. As the armor wires 538 are cabled, the conductor 542 passes through a closing eye 544 to ensure a circular profile for the cable 501. Immediately prior to entering an extruder 544, the conductor 542 is exposed to a heat source 546, which slightly melts the insulation 534 to facilitate subsequent bonding with the insulation 534. Next, a further layer of insulation 548 is preferably compression extruded from the extruder 544 over the armor wires 538, bonding through spaces between the wires 548 with the insulation 534 below to form a cable 501.

Figure 10:
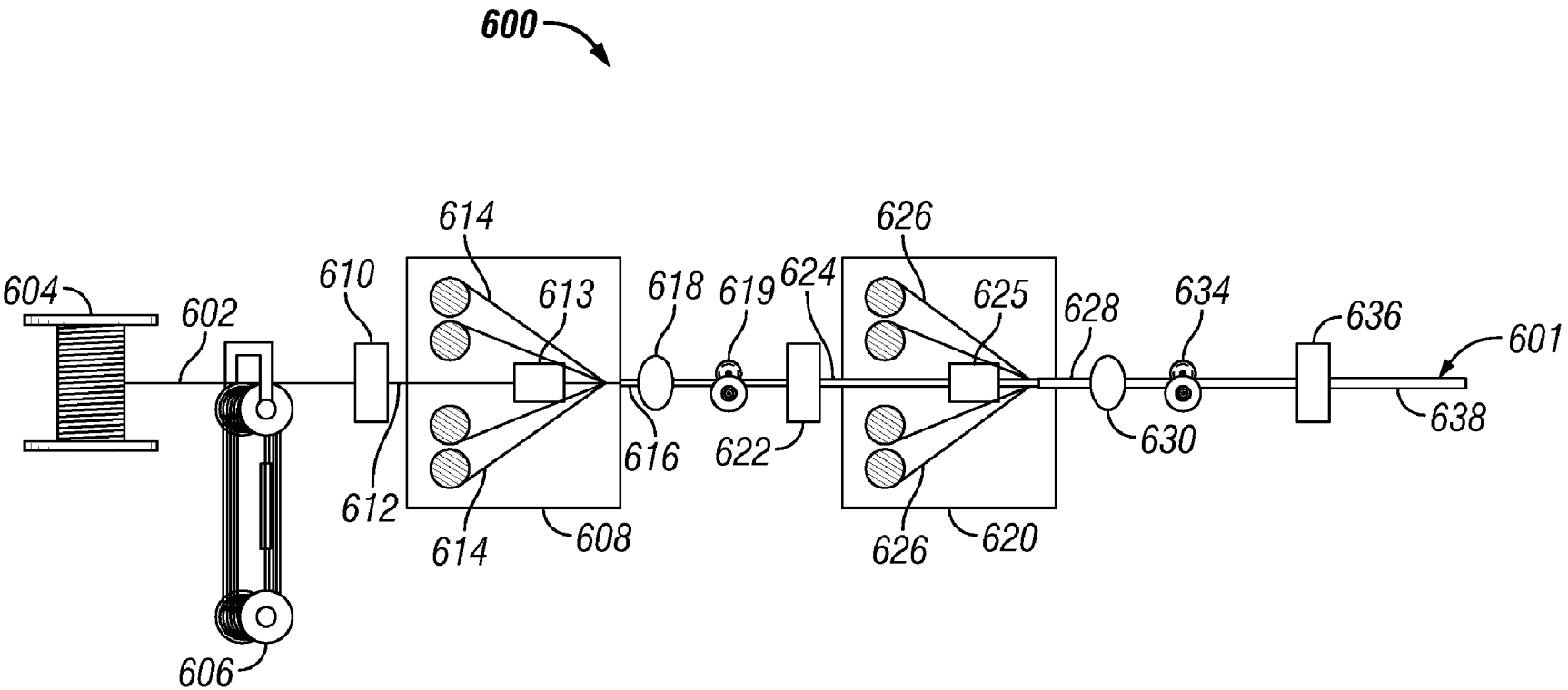
FIG. 10 is a schematic view of a method for forming a cable.

Referring now to FIG. 10, a method for forming a cable 601 is indicated generally at 600. The method 600 begins by providing a pre-manufactured cable core 602 that is placed on or wound upon a spool 604. The cable core 602 is fed from the spool 604 and passes through a cable dancer 606 to help maintain consistent tension during the jacketed armor wire process or method 600. Immediately before entering an armor machine (such as a planetary armor machine 608 shown in FIG. 10), the cable core 602 passes through an extruder 610 where a layer of preferably carbon-fiber-reinforced Tefzel® 612 is applied to the cable core 602. Those skilled in the art will appreciate the layer 612 may be formed from other materials such as, but not limited to, reinforced or non-reinforced fluoropolymers such as MFA, PFA, FEP, ETFE or the like, or polyethelenes, PPEK, PED, PPS, or modified PPS, or combinations thereof.

Figure 11:
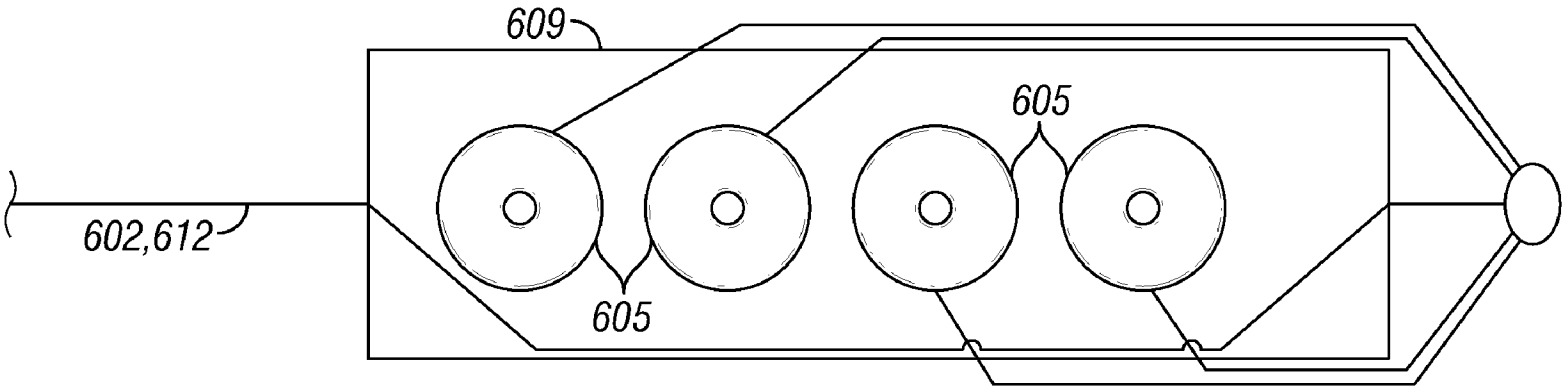
FIG. 11 (Prior Art)
FIG. 11 is a schematic view of an armoring machine of the prior art.
Figure 12:
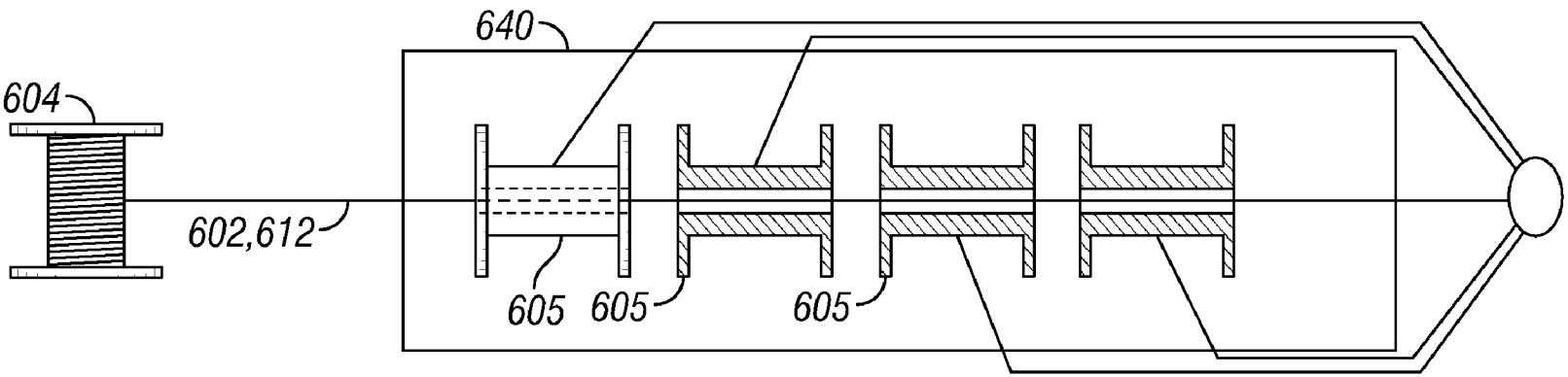
FIG. 12 is a schematic view of an armoring machine usable with the method of FIG. 10.

The 612 may be briefly air-cooled or water-cooled before entering the armor machine 608 or a tubular armoring machine 640, shown in FIG. 12. The method 600 may utilize the tubular armor machine 640 that comprises a plurality of spools 605 that each contain a strand or armor wire 614 or 626 spooled or disposed thereon that are disposed within the armor machine 640 and are preferably adapted such that the spools 605 can be turned or rotated about ninety degrees with respect to the housing of the armoring machine 640 to allow the cable core 602/612 to pass through the center of the spools 605, as shown in FIG. 12, thereby allowing the machine 640 to be utilized in a number of different cable forming methods or processes. A prior art tubular armor machine 609, shown in FIG. 11, which comprises a plurality of strand or armor spools 605 each of which are oriented at approximately a right angle to the length of a housing of the machine 609, which requires the cable core 602/612 to be routed to an outer portion or outside of the machine 609 remote from the spools, as will be appreciated by those skilled in the art. The armor machine 640 may be utilized in a manner similar to the armor machine 609, whereby the cable core 602/612 passes to an outside of the machine 640 or whereby the cable core 602/612 passes through the center of the spool or spools 605.

The layer 612 may be passed through an infrared or induction heat source 613 to soften the layer 612. While the layer 612 is still soft, the first layer of armor wire 614 is applied onto and slightly embedded into the polymer layer 612, forming the conductor 616. After the inner armor wires 614 are applied, the conductor 616 passes through a closing eye 618 to firmly embed the armor wires 614 into the layer 612. To further embed the armor wires 614 into the polymer 612 and maintain a circular profile for the cable 601, the conductor 616 passes through a pair of shaping wheels 619. Immediately before entering a second planetary armor machine 620 (or a second tubular armor machine such as the armor machine 640 shown in FIG. 12), the conductor 616 passes through an extruder 622 where a layer 624 of preferably carbon-fiber reinforced Tefzel® is applied. The layer 624 may be briefly air-cooled and/or water-cooled before entering the second tubular armoring machine 620 so that it can pass through a tubular armor machine, such as the tubular armor machine 609 shown in FIG. 11, to allow the layer 624 to remain stable enough to traverse the outside of the rotating tube on the tubular armor machine 609.

The polymer layer 624 may be passed through an infrared or induction heat source 625 to soften the layer 624. While the preferably carbon-fiber-reinforced Tefzel® layer 624 is still soft, a second layer of armor wire 626 is applied onto and slightly embedded into the polymer 624 to form a conductor 628. After the outer armor wires 626 are applied, the conductor 628 passes through a closing eye 630 to firmly embed the armor wires 626 into the carbon-fiber-reinforced Tefzel® 624. To further embed the outer armor wires 626 into the polymer 624 and maintain a circular profile for the cable 601, the conductor 628 passes through an infrared or induction heat source (not shown), such as the heat sources 108, 116, 216, 318, 406, 414, 503, 514, 524, 532, 540, or 546, before passing through a pair of shaping wheels 634. The conductor 628 then passes though a final extruder 636 where an outer jacket 638 of pure Tefzel® or carbon-fiber-reinforced Tefzel® is applied to complete the cable 601. Alternatively, the conductor 628 can be collected on a spool (not shown) after passing through the shaping wheels 634 and the final jacket layer 638 may be applied in a separate production run. FIG. 10, therefore, illustrates a method 600 that may be utilized to manufacture, for example, a gas-blocked monocable in a single production line.

The methods 100, 200, 300, 400, 500, and 600 may be utilized to produce cables, such as the cables 101, 201, 301, 401, 501, or 601 to fill interstitial spaces in metallic elements of oil exploration and other cables. The methods 100, 200, 300, 400, 500, and 600 may be used to fill interstitial spaces between stranded conductors, served shield conductors, or armor wire strength members in monocables, coaxial cables, hepta cables, seismic cables, or other cables.

The insulation for the layers 104, 204, 304, or 504 for the central strands 102, 202, 302, or 502 may be formed from any suitable insulating material including, but not limited to, polyolefin (such as ethylene-polypropylene copolymer), or fluoropolymers (such as MFA, PFA, Tefzel®). The insulation for the layers 118, 218, 320, 416, or 516, over the helical stranded conductors may be formed from, but are not limited to, one or more of the following: PEEK, PEK, Parmax B, PPS, modified PPS, polyolefin (such as ethylene-polypropylene copolymer), fluoropolymer (such as MFA, PFA, Tefzel), and the like. Similarly, for served coaxial cables, the insulation material for the layer 403 under the served shield may be any of those specified for helical stranded conductors above. Similarly, the layer 416 for the jacket over the served shield may be the same material used for the insulation or may be any other compatible material chosen from the materials listed for coaxial cables. Depending on the materials chosen, the insulation and jacket may or may not be bonded.

For seismic cables, the layers 104, 204, 304, or 504 and the layers 118, 218, 320, 416, or 516 may be formed from nylon 11 or 12, or any other nylon, polyurethane, hytrel, santoprene, polyphenylene sulfide (PPS), polypropylene (PP), or ethylene-polypropylene copolymer (EPC) or a combination of one or more polymers bonded by means of a tie layer.

For heptacables, jacket materials may be bonded continuously from the cable core 104, 204, 304, or 504 to the outermost jacket 118, 218, 320, 416, or 548 for rip resistance. Beginning with the optional tape around the cable core 105, 205, 305, or 505, all materials may be selected so that they will bond chemically with one another. Short carbon fibers, glass fibers, or other synthetic fibers may be added to the jacket 118, 218, 320, 416, 516, 534, 548, 601, 612, or 624 materials to reinforce the thermoplastic or thermoplastic elastomer and provide protection against cut-through. In addition, graphite, ceramic or other particles may be added to the polymer matrix of the outer jacket 118, 218, 320, 416, 516, 534, 548, 601, 612, or 624 to increase abrasion resistance.

A protective polymeric coating may be applied to each strand of armor wire 522, 538, 614, and 626 for corrosion protection. The following coatings may be used but are not limited to: fluoropolymer coating FEP, Tefzel®, PFA, PTFE, MFA; PEEK or PEK with fluoropolymer combination; PPS and PTFE combination; Latex or Rubber Coating. Alternatively, the armor wires 522, 538, 614, or 618, whether single armor wires or wire ropes, are coated with a virgin polymer material, in which case the "heat sink" effect of the strength member will be relied upon to interact with the electromagnetic waves and facilitate partial melting of the polymer on the armor wire 522, 538, 614, or 618 and discussed in more detail below. Alternatively, the armor wires 522, 538, 614, or 618, whether single armor wires or wire ropes, are coated with virgin polymer amended with a relatively lower percentage by weight of short carbon fibers (that is a lower percentage of short carbon fibers than used in the polymeric jacketing materials used over the cable core or over as the cable's outer jacket and discussed in more detail below. The polymeric jacketing or coating applied to the armor wires prior to the cabling process advantageously provides the possibility of including a cleaning process, as a single armor wire or wire rope can be cleaned in-line after leaving the storage spool and before the polymer is extruded over it.

Each strand of armor wire 522, 538, 614, and 626 may also be plated with a (for example) 0.5 mm to 3.0 mm metallic coating which may enhance bonding of the armor wires to the polymeric jacket materials. The plating materials may include, but are not limited to: ToughMet® (a high-strength, copper-nickel-tin alloy manufactured by Brush Wellman); Brass; Copper; Copper alloy, zinc, nickel, combinations thereof, and the like.

The jacket 118, 218, 320, 416, or 516 material and armor wire 522, 538, 614, or 626 coating material may be selected so that the armor wires 522, 538, 614, or 626 are not bonded to and can move within the jacket material 118, 218, 320, 416, or 516. Jacket materials 118, 218, 320, 416, or 516 may include polyolefins (such as EPC or polypropylene), fluoropolymers (such as Tefzel®, PFA, or MFA), PEEK or PEK, Parmax, and PPS. In some instances, virgin polymers have not sufficient mechanical properties to withstand 25,000 lbs of pull or compressive forces as the wireline cable 101, 201, 301, 401, 401, 501 or 601 is pulled over sheaves. Materials may be virgin polymers amended with short fibers. The fibers may be carbon, fiberglass, ceramic, Kevlar®, Vectran®, quartz, nanocarbon, or any other suitable synthetic material. The friction for polymers amended with short fibers may be significantly higher than that of virgin polymer. To provide lower friction, a layer of about 1.0 mm to about 15.0 mm of virgin polymer material may be added over the outside of the fiber-amended jacket.

Particles can be added to fluoropolymers or other polymers to improve wear resistance and other mechanical properties. This can be in the form of a about 1.0 mm to about 15.0 mm jacket applied on the outside of the jacket or throughout the jacket's polymer matrix. The particles may include: Ceramer™; Boron Nitride; PTFE; Graphite; or any combination of the above. As an alternative to Ceramer™, fluoropolymers or other polymers may be reinforced with nanoparticles to improve wear resistance and other mechanical properties, such as, but not limited to, an about 1.0 mm to about 10.0 mm jacket applied on the outside of the jacket or throughout the jacket's polymer matrix. Nanoparticles may include nanoclays, nanosilica, nanocarbon bundles, or nanocarbon fibers.

The materials and material properties for the layers and the armor wires may be selected from those materials recited in commonly assigned U.S. Pat. Nos. 6,600,108, 7,170,007 and 7,188,406, the entire disclosures of which are incorporated by reference herein in their entirety.

The heat sources 108, 116, 216, 318, 406, 414, 503, 514, 524, 532, 540, 546 may be one of, or combinations of, exposure to an electromagnetic radiation source or electromagnetic heating, which may be achieved using one or any combination of infrared heaters emitting short, medium or long infrared waves, ultrasonic waves, microwaves, lasers, and other suitable electromagnetic waves, as will be appreciated by those skilled in the art.

Figure 13A:
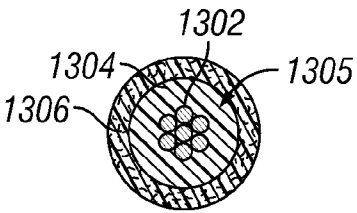
FIGS. 13*a*-13*f* are radial cross-sectional views of a cable during an embodiment of various stages of formation.
Figure 13B:
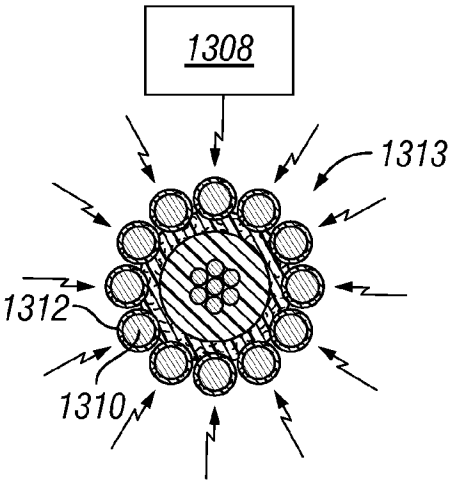

Referring now to FIG. 13*a*-13*f*, a method for forming a cable 1300 or 1301 is shown. The method begins by providing, for example, bundled strands of copper 1302, and extruding (by, for example, compression extruding or tube extruding through an extruder 103 or 114) a layer of polymeric insulation 1304 over the central strand or strands 1302 to form a cable conductor core 1305, as shown in FIG. 13*a*. The polymeric insulation 1304 may be formed from any of the polymeric materials noted above. Those skilled in the art will appreciate that the central strand 1302 may be, but is not limited to, a coated strand, an uncoated strand, or a preformed cable core comprising a plurality of conductors (such as, but not limited to, a monocable, a coaxial cable, a triad cable, a quad cable, a hepta cables, a seismic cable, or combinations thereof) and may be coated with a layer of tape (not shown) while remaining within the scope of the present invention. A layer 1306 of virgin polymer, amended with about one percent to about three percent short carbon fibers by weight, is extruded over a completed cable core 1305. The method may be performed on a separate production line with the central strand 1302 or core 1305 spooled for use in at least a second production line that completes the method, as will be appreciated by those skilled in the art. The cable conductor core 1305 next passes through a heat source 1308 shown in FIG. 13*b*, which slightly melts or softens the layer 1306 while at preferably substantially the same time a plurality of strength members 1310 having a polymeric coating 1312 thereon are cabled onto the cable core's short carbon fiber amended jacket 1306 to continue formation of the cable 1301 or 1302. The polymeric coating 1312 of the strength members is preferably a layer of virgin polymer amended to about one percent to about three percent short carbon fibers by weight and is selected such that the layer 1306 will melt prior to the layer 1312 while passing through the heat source 1308, which allows the layer 1306 to flow into and fill all interstitial spaces between the strength members 1310 as the strength members 1310 become partially to fully embedded into the cable core's jacket 1304. While the polymer coating 1312 of the strength members 1310 remains intact, the surface of the coating 1312 melts and bonds to the fiber-amended jacket 1306 below to form a cable subassembly 1313.

Figure 13C:
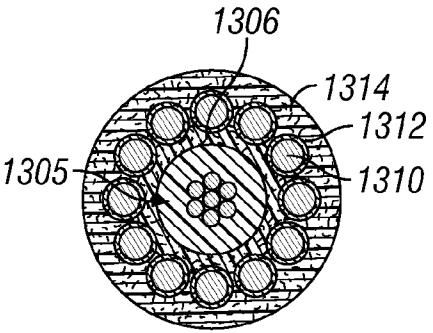
Figure 13D:
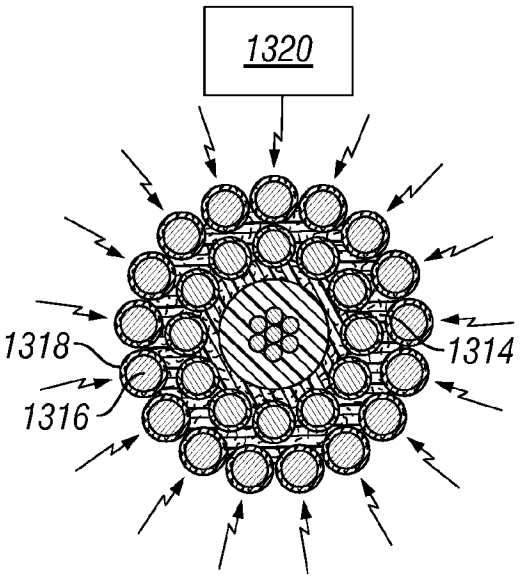
Figure 13E:
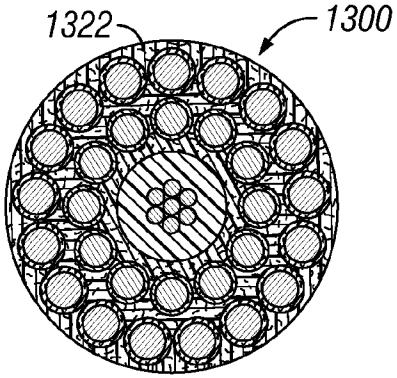
Figure 13F:
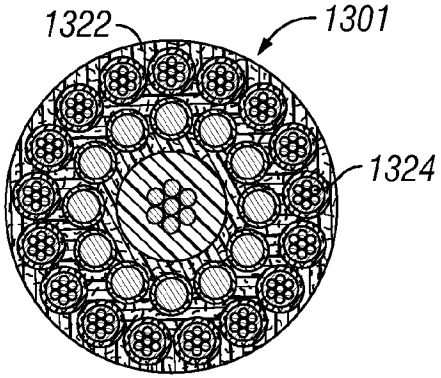

A layer 1314 of virgin polymer amended with, for example, about one percent to about three percent short carbon fibers is extruded over the cable subassembly 1313 as shown in FIG. 13*c*. Similarly, when the jacket or layer 1314 is extruded over the coated strength members 1310, the skin 1312 of the coated wire 1310 melts and is bonded to the jacket 1314 along with the fiber-amended polymer 1306 that filled the interstitial spaces between the coated wires 1310. A second layer of strength members 1316 having a polymeric coating 1318 thereon is cabled onto the cable's second short-carbon-fiber-amended jacket 1314 as electromagnetic heating is applied from a heat source 1320, as shown in FIG. 13*d*. Again, the varying melt rates for the polymeric materials 1314 and 1318 cause the cable core jacket 1314 to melt first and allow it to flow into and fill all interstitial spaces between the strength members 1316 as the strength members 1316 become partially to fully embedded into the cable core's jacket 1314. Alternatively, if a smoother, more easily sealed outer profile is desired, a final jacket 1322 of amended virgin polymer is extruded to complete the cable 1300 shown in FIG. 13*e*. Optionally, any of the coated solid armor wire strength members 1310 or 1316 may be replaced with stranded wires 1324, as shown in FIG. 13*f* to form the cable 1301. An embodiment comprises stranded armor wires 1324 in the outer strength member layer as shown in FIG. 13*f*. The cable 1300 or 1301 may pass through intermediate and/or final series of shaping dies or wheels, such as the shaping wheels 619 or 634 to maintain the a circular profile for the cable 1300 or 1301.

Preferably, to facilitate maximum bonding between polymers used in the cables, one base polymer will typically be used for the layers 1306, 1312, 1314, 1318, and 1322 in the cable 1300 or 1301 with that polymer amended with various percentages by weight of short carbon fibers. A higher percentage of short carbon fibers will interact with electromagnetic waves used in the process to give those amended polymers a faster melting time. Relatively higher percentages of short carbon fibers are used for components where faster melting times are desired to enhance the process. The range of percentages may be varied from about 0 to about 10 percent by weight of the polymer, from about 0 percent to about 5 percent by weight of the polymer, from about 0 percent to about 3 percent by weight of the polymer and/or from about 3 percent to about 5 percent by weight of the polymer.

The choice of materials for the layers 1306, 1312, 1314, 1318, and 1322, ensures that the cable core jacket 1306 and cable outer jacketing layers 1314 and 1322 will melt sooner than the strength member jackets 1312 and 1318, thereby allowing the cable core 1306 and outer jackets 1314 and 1322 to flow more readily into and fully fill all interstitial spaces in the cable 1300 or 1301. Also, because the polymer jacketing 1312 and 1318 over the strength members 1310 and 1316 remains intact during the cabling process, any residual contamination on the strength members 1310, 1316, and 1324 will not be transferred into the overall jacket system where it could negatively impact bonding between the different layers. The strength members 1310, 1316, and 1324 may also be plated with a tie-layer metal (not shown), such as brass or the like, to facilitate bonding between the strength members and their individual jackets.

The polymer 1306 used for jackets applied over the cable core or over the strength members 1310, 1316, and 1324 may be virgin polymer amended by from about one percent to about three percent weight short carbon fibers. When this amended polymer 1306, 1314 or 1322 in the jacketing materials is exposed to electromagnetic heating, it melts at a faster rate than the polymer coating 1312 and 1318 of the strength members 1310, 1316, and 1324. This allows the cable jacketing layers to deform and flow into the interstitial spaces between the coated strength members. Because the strength member jacket's surfaces 1312 and 1318 also melt slightly (if to a lesser degree) the two polymeric materials 1306, 1314, or 1322 and 1312 and 1318 bond to each other to create a continuously bonded matrix of jacketing and strength members.

Armor wires 1310, 1316, and 1324, whether single armor wires or wire ropes, have polymeric jacketing applied to them prior to the cabling process, which provides the possibility of including a cleaning process, as a single armor wire or wire rope 1310, 1316, and 1324 can be cleaned in-line after leaving the storage spool and before the polymer is extruded over it. Depending on process conditions in the cabling process, this polymeric jacket used for the strength members may be virgin polymer (in which case the "heat sink" effect of the strength member will be relied upon to interact with the electromagnetic waves and facilitate partial melting of the polymer), or virgin polymer amended with a relatively lower percentage by weight of short carbon fibers (that is a lower percentage of short carbon fibers than used in the polymeric jacketing materials used over the cable core or over as the cable's outer jacket.

Alternatively, the same materials and components shown in FIGS. 13*a*-13*f* are used in single-run or multiple-run cabling process or method similar to, but not limited to, the methods 500 and 600. In this process or method, the strength members 1310 are cabled into and imbedded into the cable core jacket 1306 immediately after the cable core jacket 1306 is extruded onto the cable core 1305. The relatively higher amounts of short carbon fibers in the freshly applied cable core jacket 1306 allow it to deform easily into and around the polymeric jacketing 1312 on the pre-coated strength members 1310. Subsequent jacketing layers 1314 and 1322 and armor wires layers 1316 and 1324 may be applied either during the same run or subsequent runs until the final outer jacketing 1322 is applied. The single-line process may comprise a polymeric jacket 1306 extruded over a completed cable core 1305, followed by polymer-jacketed strength members 1310 (either single armor wires or wire ropes) cabled over and almost fully or fully embedded into the still-soft polymer 1306 over the cable core 1305. Typically, these strength members 1310 are applied at a lay angle. The polymer jacket 1306 flows into and fills all interstitial spaces between the strength members 1310. The cable may pass through intermediate and/or final series of shaping dies or wheels, such as the shaping wheels 619 or 634 to maintain a circular profile for the cable 1300 or 1301.

A second polymeric jacket layer 1314 is extruded over the inner strength member layer 1310. A second layer of polymer-jacketed strength members 1316 (either single armor wires or wire ropes) are cabled over and almost fully or fully embedded into the still-soft polymer 1314 over the cable subassembly 1313. Typically these strength members 1316 will be applied at an opposite lay angle to those in the inner strength member layer 1310. The polymer jacket 1314 flows into and fills all interstitial spaces between the strength members. A final outer polymeric jacket 1322 may be applied to create a smooth, uniformly circular profile to complete the cable 1301 or 1302.

Alternatively, the method may be utilized to produce a marine seismic cable wherein a layer of virgin polymer amended with, for example, about one percent to about three percent short carbon fibers by weight is extruded over a completed gun cable core and polymer-coated strength members are cabled onto the gun cable core's short-carbon-fiber-amended jacket as electromagnetic heating is applied. The varying melt rates for the polymeric materials cause the cable core jacket to melt first and allow it to flow into and fill all interstitial spaces between the strength members as the strength members become partially to fully embedded into the gun cable core's jacket and a layer of short-carbon-fiber-amended polymer is extruded over the strength members to complete the cable.

The armor wires 522, 538, 614, 626, 1310, 1316, and 1322 or conductors 106, 206, 306, 404, or 506 may be heated prior to embedding into the layers by, in non-limiting examples, induction heating of metal, ultrasonic heating, or thermal heating using radiation or conduction, as will be appreciated by those skilled in the art.

The above-mentioned methods 100, 200, 300, 400, 500, and 600 are examples of some approaches, which may be used alone, or in combination, to embed metallic elements or coated strength members in to cable insulation layers or jackets or insulation as described above.

In the above-mentioned methods 100, 200, 300, 400, 500, and 600, wire elements (such as helical conductor strands, served shield wires, or armor wires) are cabled onto polymer-encased central elements (such as central conductor strands, insulated conductors or cable cores) at a given coverage into a slightly melted or softened insulation, allowing the cabled wires to embed themselves in the insulation. As the cabled wires embed, they achieve a greater coverage at a smaller circumference. Correspondingly, a shorter length of cabled wire elements is required to cover the smaller circumference.

For example, on a monocable, served shield wires might be cabled onto a central insulated conductor at a coverage between about 80% and about 85%. Within a few inches or feet, the cable passes through an electromagnetic heat source to soften the insulation, and the served wires embed themselves in the insulation. Because the wires are now distributed around a smaller circumference, coverage increases to between 93 and 98%. Over the length of a wireline cable, cabling at the smaller diameter also requires significantly less length.

Assume a monocable is assembled by applying 0.0323 inch diameter armor wires at a 22 degree lay angle over a jacket with an initial diameter of 0.124 in, as shown in the equations and calculations listed below. The total initial diameter is 0.1866 in. The jacket is then softened to allow the armor wire to partially embed into the jacket, such that the resulting total diameter is 0.1733 in. As described in the calculations below, the length of armor wire required to wrap around the core at the 22 degree lay angle is 10.16% shorter at the smaller diameter. Over a 24,000-ft. monocable, this is a difference of approximately 2,440 ft. for each armor wire, as shown in the equations and calculations listed below.

Coverage and excess length equations for a hypothetical monocable are listed below:

$$D = \text{pitch diameter}$$

$$D = D_c + d_w$$

$$D_c = \text{Diameter of core}$$

$$d_w = \text{Diameter of armor wire}$$

$$C_1 = \text{Total circumference at pitch diameter} = \pi(D_c + d_w) = \pi D$$

$$C_2 = \text{Total metal circumference at pitch diameter}$$

$$m = \text{Number of metal elements}$$

$$C_2 = mx\frac{d_w}{\cos\alpha}$$

$$C\ \% = \text{Metal coverage at the pitch diameter}$$

$$C\ \% = \frac{md_w}{\pi D\cos\alpha} \times 100$$

$$D_a = \text{Initial diameter}$$

$$D_a = 0.124 \text{ in.} + 0.0323 \text{ in.} = 0.1563 \text{ in.}$$

-continued $$\lambda_a = \text{Length of one wrap of armor wire at } D_a$$

$$\lambda_a = \frac{\pi \times 0.1563 \text{ in.}}{\tan 22} = 1.22$$

$$D_b = \text{Final diameter}$$

$$D_b = 0.109 \text{ in.} + 0.0323 \text{ in.} = 0.141 \text{ in.}$$

$$\lambda_b = \text{Length of one wrap of armor wire at } D_b$$

$$\lambda_b = \frac{\pi \times 0.141 \text{ in.}}{\tan 22} = 1.096 \text{ in.}$$

$$\lambda_b = \text{Length of one wrap of armor wire at } D_b$$

$$\lambda_b = \frac{\pi \times 0.141}{\tan 22} = 1.096$$

$$\therefore$$

$$\frac{\Delta\lambda}{\lambda_a} = \text{Difference in lay length as fraction of } \lambda_a$$

$$\frac{\Delta\lambda}{\lambda_a} = \frac{0.124}{1.22} = 10.16\%$$

$$L_a = 24{,}000 \text{ ft}$$

$$L_b = (0.1016 \times 24{,}000 \text{ ft.}) + 24{,}000 \text{ ft.} = 26{,}439 \text{ ft.}$$

$$\Delta L = L_b - L_a$$

$$\therefore$$

$$\Delta L = 26{,}439 \text{ ft.} - 24{,}000 \text{ ft.} = 2439 \text{ ft.}$$

This length could obviously not be taken out of a 24,000-foot cable after the armor wire had been completed. The methods or processes described herein are only possible because the excess length is taken up by tension at the armor wire spools as the diameter is reduced. The rate of speed of payoff of the armor wire from the spools is slowed to account for the excess length "going back" to the spools.

The preceding description has been presented with reference to presently preferred embodiments of the invention. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

What is claimed is:

1. A method of forming at least a portion of a cable, comprising:

providing at least one cable conductor core;

extruding at least an inner layer of a polymeric insulation material over the at least one conductor core;

providing a plurality of strength members having a coating of the polymeric insulation material;

heating the at least one cable conductor core and the strength members;

embedding the strength members into the inner layer of the cable conductor core; and extruding an outer layer of the polymeric insulation material over the cable conductor core and the plurality of strength members and bonding the outer layer to the inner layer and the coating to form the cable and provide a contiguous bond between the inner layer, the strength members, and the outer layer, wherein the polymeric insulation material of the inner layer, the strength member coating, and the outer layer are amended to enable the inner layer and the outer layer to melt at a greater rate than the strength member coating.

2. The method according to claim 1, wherein heating comprises exposing the cable conductor core and the strength members to an electromagnetic radiation source.

3. The method according to claim 1, wherein heating comprises extruding the inner layer over the strength members and substantially immediately thereafter embedding the plurality of strength members into the freshly extruded inner layer.

4. The method according to claim 1, wherein heating and embedding are performed substantially simultaneously.

5. The method according to claim 1, wherein the polymeric material is a virgin polymer.

6. The method according to claim 1, wherein the inner layer comprises a short carbon fiber in an amount of about three percent to about five percent by weight based on total inner layer weight, and wherein the outer layer comprises a short carbon fiber in an amount of about three percent to about five percent by weight based on total outer layer weight.

7. The method according to claim 1, wherein the at least one cable conductor core comprises one of a monocable, a coaxial cable, a triad cable, a quad cable, a hepta cable, and a seismic cable.

8. The method according to claim 1, wherein the plurality of strength members comprises at least one of solid armor wire strength members and stranded wire strength members.

9. A method of forming a cable, comprising:

providing at least one cable conductor core;

extruding at least an inner layer of a polymeric insulation material over the at least one conductor core;

providing a plurality of strength members having a coating of the polymeric insulation material;

heating the at least one cable conductor core and the strength members;

embedding the strength members into the inner layer of the cable conductor core substantially immediately after heating; and extruding an outer layer of the polymeric insulation material over the cable conductor core and the plurality of strength members and bonding the outer layer to the inner layer and the coating to form the cable and provide a contiguous bond between the inner layer, the strength members, and the outer layer, wherein the polymeric insulation material of the inner layer, the strength member coating, and the outer layer are amended to enable the inner layer and the outer layer to melt at a greater rate than the strength member coating.

10. The method according to claim 9, wherein heating comprises exposing the inner layer to an electromagnetic radiation source.

11. The method according to claim 9, wherein the at least one cable conductor core comprises a one of a monocable, a coaxial cable, a triad cable, a quad cable, a hepta cable, and a seismic cable.

12. The method according to claim 9, wherein the plurality of strength members comprises one of solid armor wire strength members and stranded wire strength members.

13. The method according to claim 9, wherein the inner layer and outer layer are amended with short carbon fiber to enable the layers to melt at a greater rate than the strength member coating.

14. The method according to claim 9, further comprising providing a second plurality of strength members having a coating of the polymeric insulation material;

heating the outer layer and the second plurality of strength members;

embedding the second plurality of conductors into the outer layer of the cable substantially immediately after heating; and extruding a second outer layer of polymeric insulation over the cable and the second plurality of conductors and bonding the outer layer to the second outer layer to form the cable and provide a contiguous bond between the inner layer, the strength members, the outer layer, the second strength members, and the second outer layer, wherein the second outer layer is amended to enable the second outer layer to melt at a greater rate than the strength member coating.

15. A method of forming a cable, comprising:

providing at least one cable conductor core;

providing a plurality of strength members having a coating of the polymeric insulation material;

extruding a first layer of a polymeric insulation material over the at least one conductor core;

embedding the strength members into the inner layer of the cable conductor core substantially immediately after extruding;

extruding a second layer of the polymeric insulation material over the cable conductor core and the plurality of strength members and bonding the second layer to the inner layer and the coating to form the cable and provide a contiguous bond between the first layer, the strength members, and the second layer;

providing a second plurality of strength members having a coating of the polymeric insulation material;

embedding the second plurality of strength members into the second layer substantially immediately after extruding; and extruding a third layer of polymeric insulation over the second layer and the second plurality of strength members to form the cable and provide a contiguous bond between each of the layers and the strength members, wherein the polymeric insulation material of the layers and strength members are amended to enable the layers to melt at a greater rate than the strength member coating.

16. The method according to claim 15, wherein the at least one cable conductor core comprises a one of a monocable, a coaxial cable, a triad cable, a quad cable, a hepta cable, and a seismic cable.

17. The method according to claim 15, wherein the plurality of strength members comprises one of solid armor wire strength members and stranded wire strength members.

18. The method according to claim 15, wherein the polymeric material is a virgin polymer.

19. The method according to claim 15, further comprising passing the cable through at least one shaping die or wheel.

20. The method according to claim 15, wherein at least one of the first, second, and third layers is amended with short carbon fiber to enable the layers to melt at a greater rate than the strength member coating.

* * * * *